United States Patent [19]

Corna et al.

[11] Patent Number: 4,991,239

[45] Date of Patent: Feb. 12, 1991

[54] BULKHEADS FOR SWIMMING POOLS

[76] Inventors: John F. Corna, 1542 Northcrest Ave., Columbus, Ohio 43220; Marcel H. Blais, 8085 Manitou Dr., Westerville, Ohio 43081

[21] Appl. No.: 821,010

[22] Filed: Jan. 21, 1986

Related U.S. Application Data

[63] Continuation of Ser. No. 535,041, Sep. 23, 1983, abandoned, which is a continuation of Ser. No. 337,592, Jan. 7, 1982, abandoned.

[51] Int. Cl.[5] ..... E04H 4/14

[52] U.S. Cl. ..... 4/505

[58] Field of Search ..... 4/505, 506; 220/22.2, 220/22.5; 52/64, 126.4; 312/250, 311; 248/647; 308/161, 190; 16/97, 102, 106, 107

[56] References Cited

U.S. PATENT DOCUMENTS

| | | | |
|---|---|---|---|
| 2,284,427 | 5/1942 | Hufferd et al. | 16/107 |
| 2,841,410 | 7/1958 | Kessler, Jr. et al. | 312/250 |
| 3,335,532 | 8/1967 | Greenbie | 52/126.4 |
| 3,482,894 | 12/1969 | Pryor | 312/250 |
| 3,935,599 | 2/1976 | Stark | 4/505 |
| 3,962,735 | 6/1976 | Davidson | 4/505 |
| 4,292,696 | 10/1981 | Berger | 4/505 |

*Primary Examiner*—Charles E. Phillips

[57] ABSTRACT

A bulkhead for use in a swimming pool that is moveable to selected positions along the length of the pool to divide the pool into various activity areas. The bulkhead includes supporting wheels mounted on tracks and is further characterized by jacking means for unloading the supporting wheels when the bulkhead is stationary.

4 Claims, 6 Drawing Sheets

BULKHEADS FOR SWIMMING POOLS

This is a continuation of application Ser. No. 06/535,041, filed Sept. 23, 1983, which is itself a continuation of application Ser. No. 337,592, filed Jan. 7, 1982.

This invention relates to moveable bulkheads for use in swimming pools and more particularly to a novel wheeled supporting system provided with means for removing the load of the bulkhead from the wheels when the bulkhead is in a stationary position.

BACKGROUND OF THE INVENTION

It is the present practice in the art to fabricate moveable bulkheads for swimming pools with supporting wheels mounted on the ends of the bulkhead with the wheels being positioned on tracks that extend along the length of the pool.

Prior art supporting wheels have rim portions formed of hard plastic and rubber materials due to the smooth, quiet operational characteristics of such wheels when operated on tracks formed by stainless steel portions of the gutter. With the advent of larger pools and longer and heavier bulkheads a problem has been present in that wheels having rim portions formed of hard plastic and rubber materials become deformed under the increased loadings and take an out-of-round "set" or configuration when they remain stationary under load for extended periods of time. As a result, the deformed wheels resist movement and are no longer smooth in operation. Another problem has been present in that the supporting wheels for such bulkheads inherently tend to bind, causing canting and jamming that arrest movement when the bulkhead is being repositioned.

SUMMARY OF THE INVENTION

In general, the present invention uses novel supporting carriages for mounting the bulkhead on its tracks, which carriages include jacking means for selectively raising and lowering the above mentioned supporting wheels between upper unloaded positions wherein the wheels are clear of their track, and a lower loaded position wherein the wheels engage their track and thereby moveably support the bulkhead.

It is another object of the present invention to provide a swimming pool bulkhead that comprises novel supporting carriages that include bearing plates which can be selectively moved into load supporting positions on the tracks wherein the load of the bulkhead is distributed over relatively large load supporting areas of the tracks.

It is another object of the present invention to provide a swimming pool bulkhead that includes load distributing bearing plates for selective engagement with the tracks and adjustable jacking means for distributing the load along the linear length of the bearing plates.

It is another object of the present invention to provide a swimming pool bulkhead that comprises novel supporting carriages provided with selectively positionable load supporting bearing plates, and adjustable mounting means for accurately aligning the supporting carriages and bearing plates with respect to their tracks.

It is still another object of the present invention to provide a swimming pool bulkhead that includes supporting wheels for movement of the bulkhead along its tracks, and supporting carriages for selectively relieving said wheels from their load, said bulkhead being uniquely adapted to shift laterally with respect to its supporting wheels and tracks when the bulkhead is being moved, thereby preventing binding at said wheels. Hence, canting of the bulkhead is prevented or relieved, with the result that the bulkhead can be readily moved and repositioned without jamming.

Further objects and advantages of the present invention will be apparent from the following description, reference being had to the accompanying drawings wherein a preferred form of embodiments of the invention is clearly shown.

DESCRIPTION OF THE PREFERRED EMBODIMENT

Figure 1:
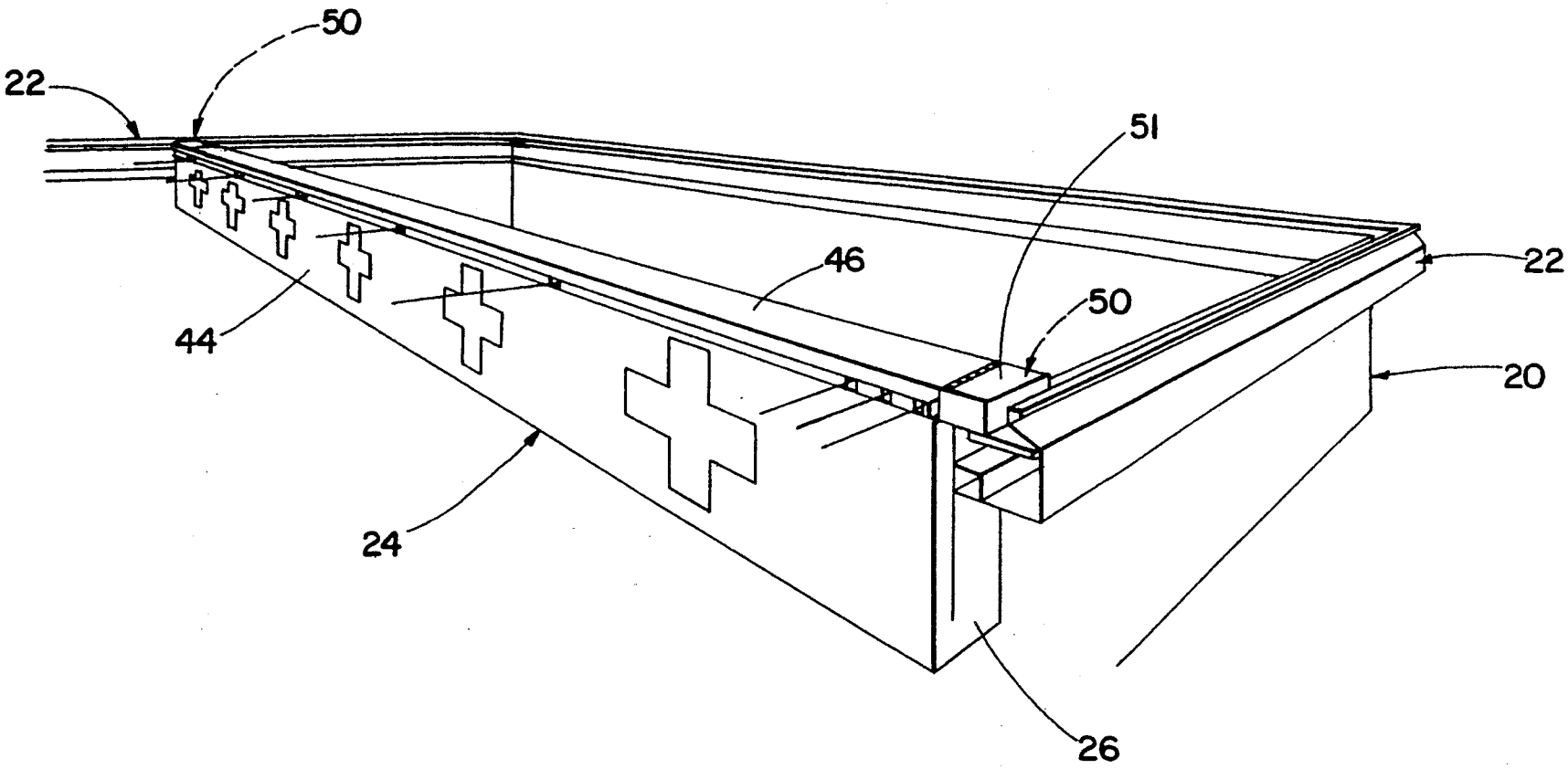
FIG. 1 is a partial perspective view showing a typical swimming pool with a bulkhead of the present invention installed therein.

Referring in detail to the drawings, FIG. 1 illustrates a typical swimming pool, indicated generally at 20, which includes a stainless steel gutter construction, indicated generally at 22.

A bulkhead constructed in accordance with the present invention is indicated generally at 24 and is moveably mounted on tracks formed by gutter construction 22 and functions to divide the pool into various selected activity areas.

Figure 2:
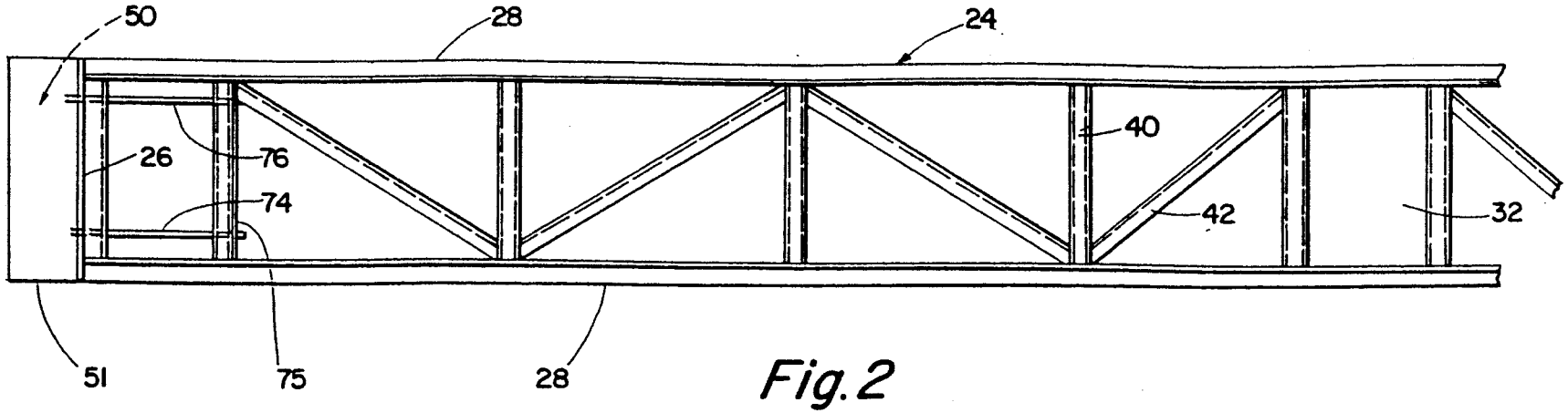
FIG. 2 is a top elevational view showing the frame structure of a bulkhead constructed in accordance with the present invention.
Figure 3:
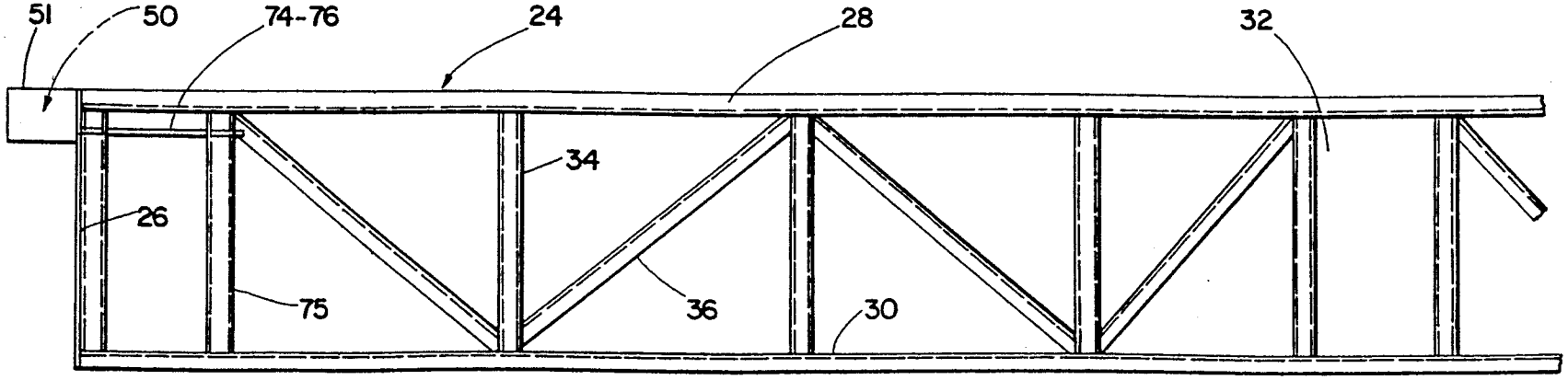
FIG. 3 is a side elevational view corresponding to FIG. 2.

With reference to FIGS. 1–3, bulkhead 24 includes a frame constructed as a truss including longitudinal frame members 28 and 30, transverse frame members 34, 36, 40 and 42. As seen in FIG. 1, the truss frame is covered with side walls 44 and a top walkway 46, and includes one or more air compartments 32 to provide flotation support for the structure.

As seen in FIGS. 2 and 3, each end of bulkhead 24 is moveably supported by a supporting carriage, with the locations of these carriages being indicated generally at 50 in FIGS. 2 and 3. Each carriage includes a removable protective cover 51.

Figure 4:
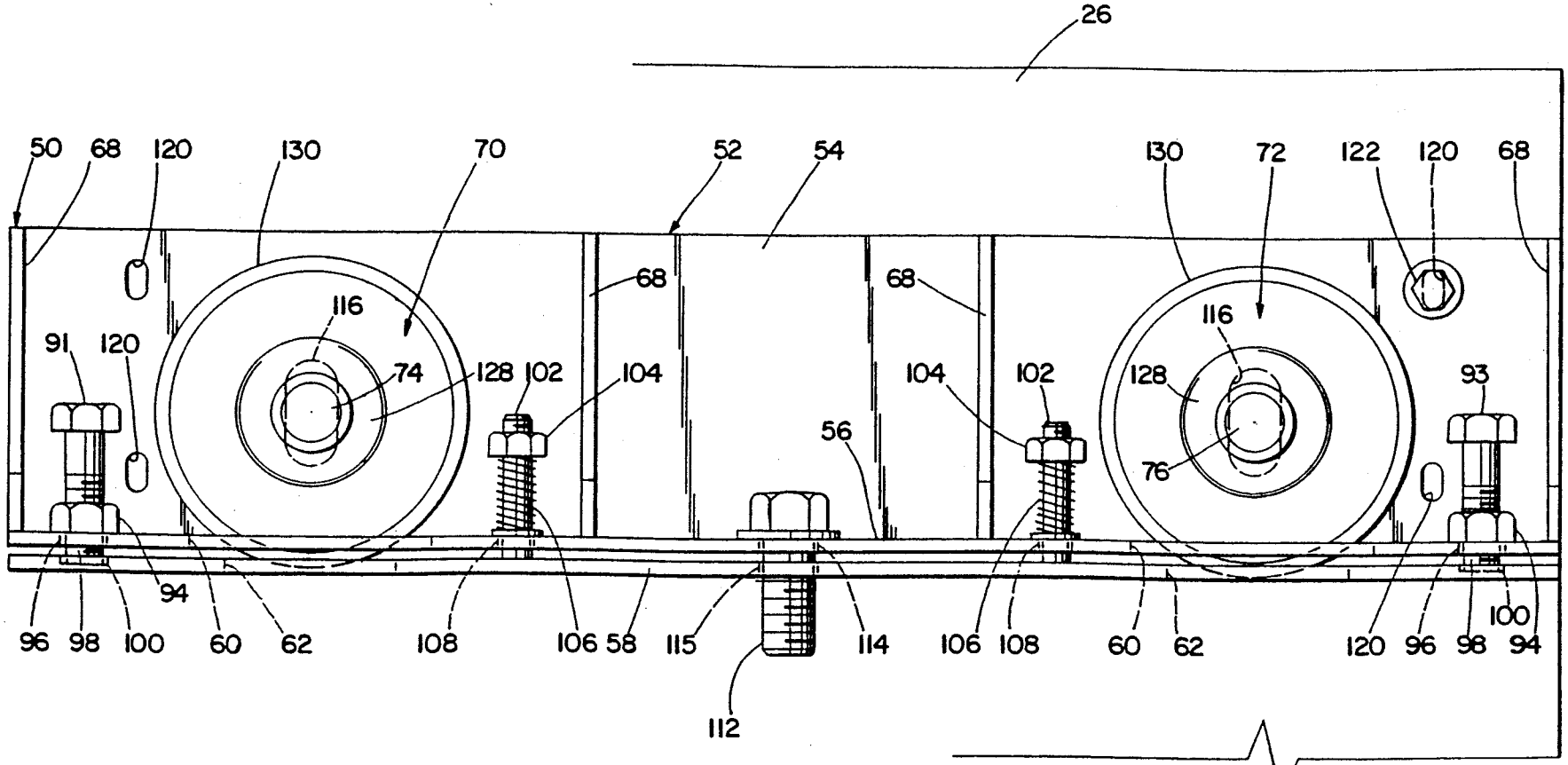
FIG. 4 is a side elevational view of a supporting carriage comprising a portion of the bulkhead of the present invention.
Figure 5:
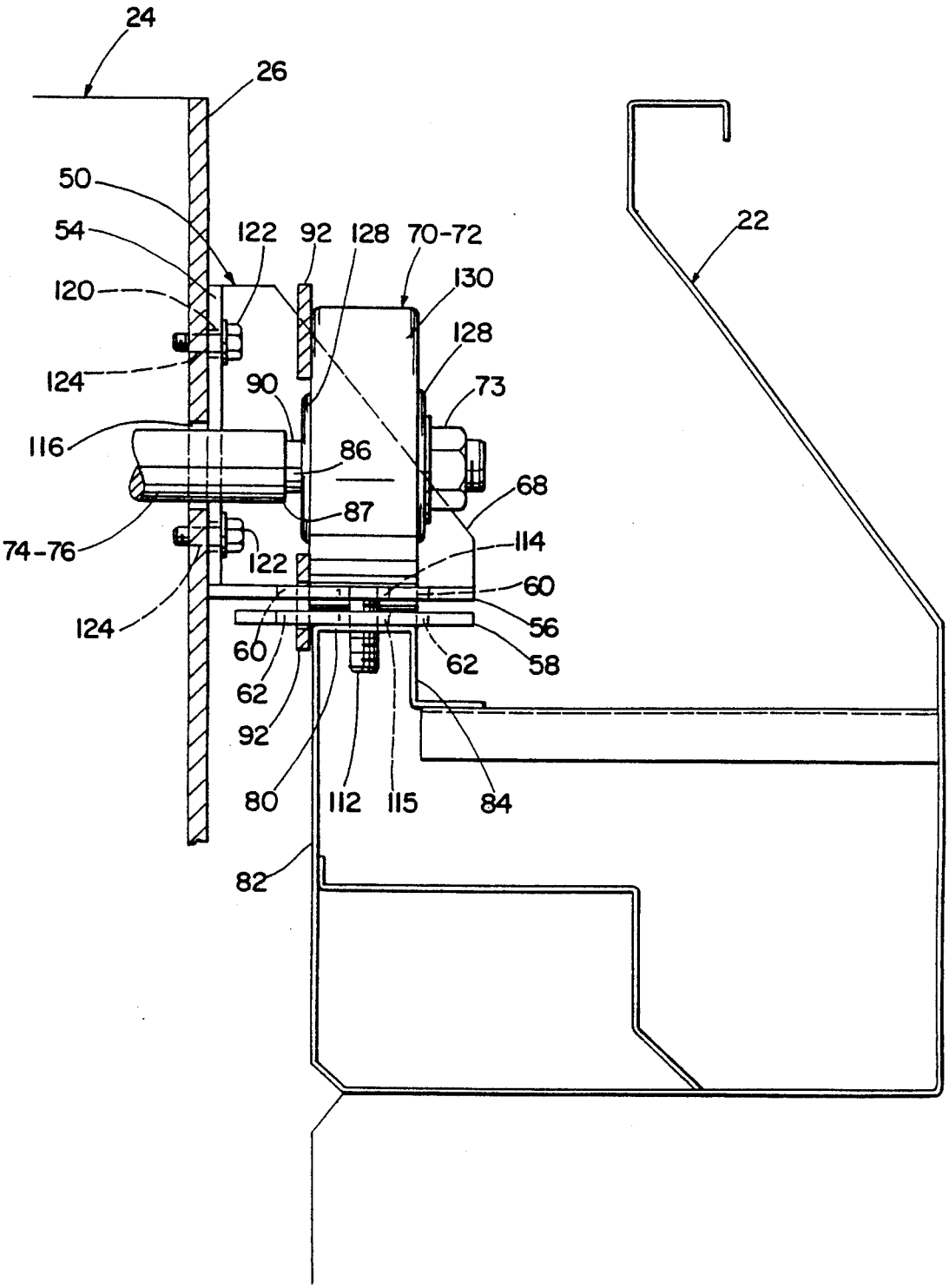
FIG. 5 is a partial end sectional view showing the carriage of FIG. 4 mounted on an end plate of the bulkhead of the present invention.

Reference is next made to FIGS. 4 and 5, which illustrate in detail the structural components of the supporting carriages 50.

Each supporting carriage 50 functions as a jacking means for relieving two supporting wheels 70 and 72 from the weight of bulkhead 24, when the bulkhead is in a stationary position. The carriage 50 also includes a bearing plate 58 that functions to distribute the load of the bulkhead over a relatively large area of a track 80, thereby greatly decreasing the unit loading on the track. In addition, carriage 50 serves to anchor the bulkhead in various selected positions and includes mounting means for effecting alignment of the carriage with its respective track.

As seen in FIGS. 4 and 5, each carriage 50 includes a carriage frame 52 that includes a side plate 54, bottom plate 56, and spaced reinforcing gussets 68. The frame 52 is mounted on an end plate 26 of the bulkhead by four bolts 122 which extend through vertical slots 120 in side plate 54 and into threaded engagement with a respective threaded hole 124. It will now be understood that each end of carriage frame 52 can be vertically adjusted independently, thereby permitting alignment of carriage frame 52 with its respective track.

It should be mentioned that two axles 74 and 76 are mounted on each end of the bulkhead by extending each axle through holes in end plate 26 and axle mounting plate 75, which plates comprise part of the bulkhead frame structure. Since axles 74 and 76 extend through side plate 50 of carriage 50, the vertical slots 116 are provided in side plate 54 to permit the above mentioned vertical adjustment thereof.

With reference to FIGS. 4 and 5, bearing plate 58 is mounted under bottom plate 56 by two threaded guide pins 102 and 103 which have their bases welded to the top of bearing plate 58 and which extend freely through holes 108 in bottom plate 56. Each guide pin 102 and 103 includes a compression spring 106 and retainer nut 104 which serve to bias bearing plate 58 upwardly and clear of track 80.

With continued reference to FIGS. 4 and 5, each carriage 50 includes jacking means for lifting the carriage frame 54 and wheels 70 and 72 to upper positions wherein the wheels are clear of track 80 and wherein the bearing plates 58 engage track 80 and support the weight of the bulkhead. Such jacking means comprises two bolts 91 and 93 which are located at respective ends of carriage frame 54, with each bolt being in threaded engagement with a nut 94 welded to bottom plate 56. The tip 98 of each bolt extends freely through a hole in bottom plate 56 and into rotatable engagement with the bottom of a bearing recess 100.

It should be mentioned that wheel clearance openings 60 and 62 are provided in bottom plate 56 and bearing plate 58, respectively, so as to permit engagement of wheels 70 and 72 with tracks 80.

As is best seen in FIGS. 4 and 5, the carriage means 50 is locked in selected positions along track 80 by means of a tie-down bolt 112 that extends freely through slots 114 and 115 in base plate 56 and bearing plate 58, respectively.

It should be mentioned that the spacing of tracks 80 will, as a practical matter, vary due to errors in fabrication and erection.

Another problem is present when the bulkhead is being repositioned in that, if one side of the bulkhead is moved more than the other, then the guide plates 92, at diagonally opposite corners of the bulkhead, will be biased against the sides of their respective tracks 80. This causes binding of such diagonally opposite wheels, which will arrest movement of the bulkhead.

It should also be mentioned that wheels 70 and 72 include central hub or bearing portions 128 formed of suitable bearing material and resilient rim portions or tires 130 formed of rubber, plastic or the like. Each wheel may also be provided with a fixed circular guide plate 92 mounted on the side of the rim portion and extended to engage the side of track 80. Also, each wheel is mounted freely on necked axle portion 86, so as to be laterally shiftable with respect to a shoulder 87 that is spaced from the side of bearing portion 128 to provide clearance 90 for self aligning movement of the wheel when the bulkhead is being moved and when the guide plate 92 encounters a misaligned portion of track 80.

Since each wheel is free to move laterally along necked axle portion 86, due to clearance 90 between shoulder 87 and the side of the wheel, it will be understood that each wheel can adjust laterally for variations in alignment of their tracks 80 and thereby avoid binding engagement when the bulkhead is being moved.

Clearance 90 between wheels 70–72 and their respective shoulders 87 serves an additional function in that such clearance 90 permits lateral shifting of the entire bulkhead 24 with respect to wheels 70–72 when the wheels are frictionally engaging the tracks 80. This feature eliminates the above mentioned canting problem which occurs when the bulkhead is being repositioned and one side of the bulkhead is moved more than the other side, as discussed above.

It should also be mentioned that clearance 90 for lateral shifting of the wheels and bulkhead can be varied by repositioning nut 73 with respect to shoulder 87.

Hence it will be understood that clearance 90 can be established by adjusting nut 73 to provide sufficient lateral movement of wheels 70 and 72 to accommodate the maximum and minimum track spacing that will encounter the particular track installation.

Figure 6:
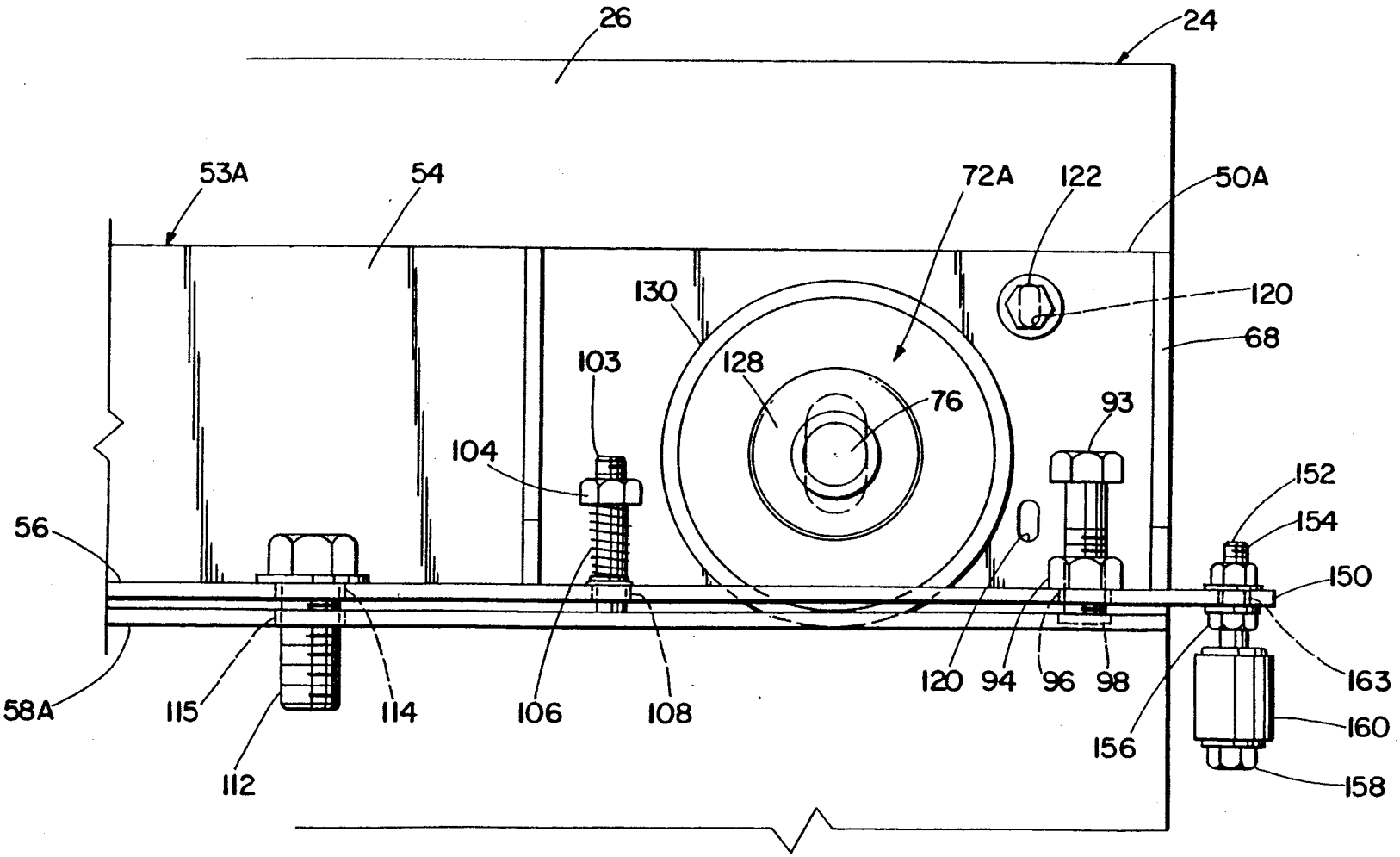
FIG. 6 is a partial side elevational view showing a modified carriage that comprises a modified embodiment of the present invention.
Figure 7:
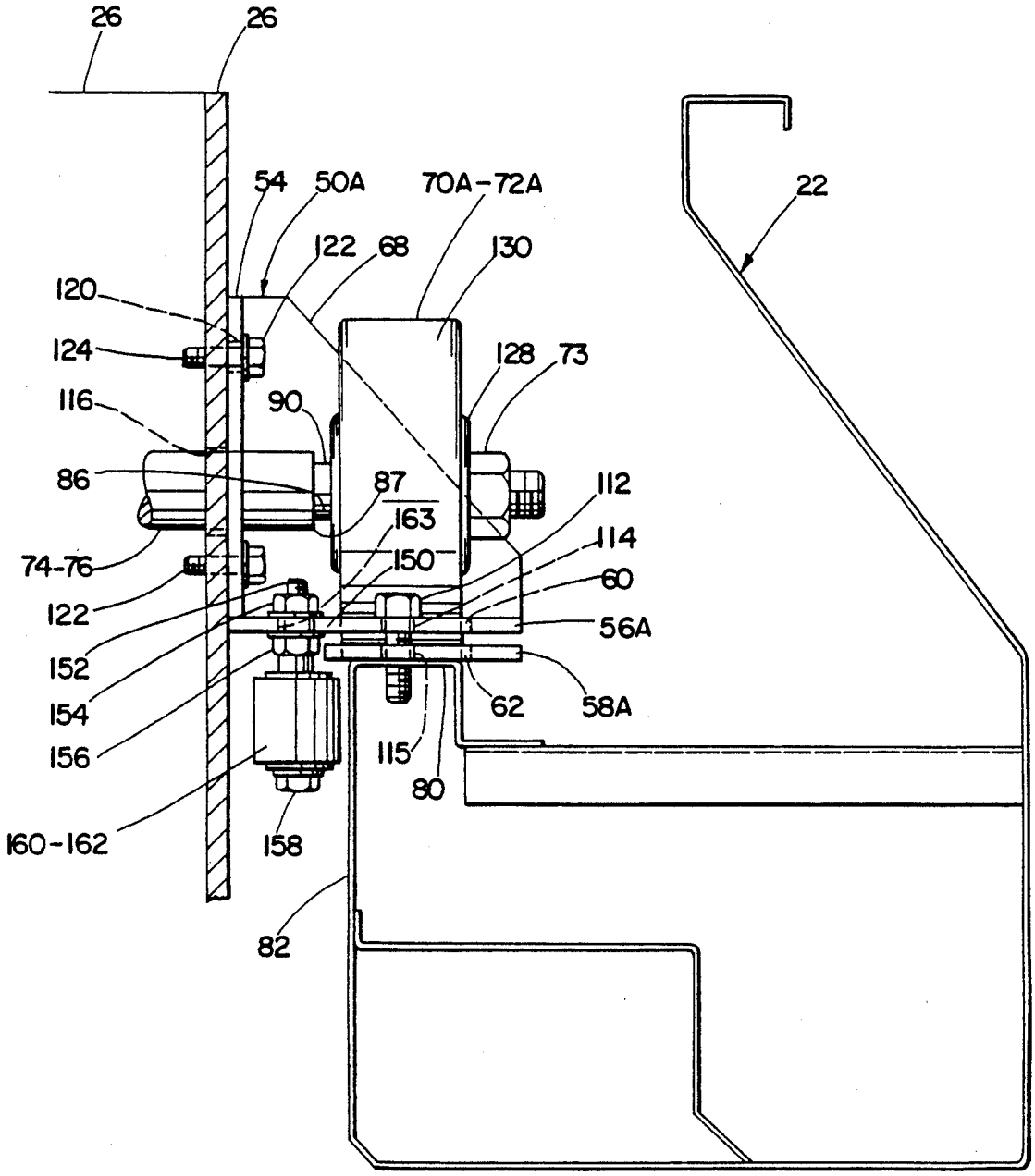
FIG. 7 is an end sectional view showing the modified carriage of FIG. 6.

Reference is next made to FIGS. 6 and 7 which illustrate a modified carriage means 50-A that differs from the carriage means 50 of FIGS. 4 and 5 in that front and rear guide rollers 160 and 162 are respectively mounted on opposite ends of modified carriage means 50-A. One of these guide rollers 160 is shown in the partial side view of FIG. 6 with the other guide roller 162 being of identical construction and mounted on the opposite end of the carriage.

It should be pointed out that guide rollers 160 and 162 function as guide means for maintaining wheels 70-A and 72-A on their respective tracks 80, whereby the fixed circular guide plates 92 mounted on wheels 70 and 72 of the embodiment of FIGS. 4 and 5 are not required in the modified embodiment of FIGS. 6 and 7.

Referring in detail to FIGS. 6 and 7, each of the guide rollers 160 and 162 is mounted on a respective end of a modified carriage bottom plate 56-A which includes roller mounting slots 163 formed through end extensions 150 on bottom plate 56-A. Each guide roller 160-162 is rotatably mounted on a threaded shaft 152 that is secured in hole 163 by mounting nuts 154 and 156.

The modified embodiment of FIGS. 6 and 7 includes various identical structural components previously described above in the description of the embodiment of FIGS. 4 and 5, with such identical components being marked with identical numerals.

In operation of the embodiment of FIGS. 6 and 7, it should be mentioned that the guide means provided by guide rollers 160 and 162 functions to prevent canting of the bulkhead during movement thereof. Such guide means also cooperate with the clearance spaces 90 provided at wheels 70-A and 72-A. Such clearance space 90 permits lateral shifting movement of bulkhead 24 with respect to wheels 70-A and 72-A, thereby precluding binding of wheel rotation. As a result, canting of bulkhead 24 is usually prevented from starting, and in instances where the canting tendency has started, it is relieved as movement of bulkhead 24 progresses. As a result, binding against rotation of the wheels is eliminated.

We claim:

1. In a water-filled swimming pool, a moveable bulkhead having flotation means, extending between opposed rectilinear swimming pool vertical sidewalls having a gutter secured to each of said sidewalls that can be utilized as a supporting and guiding track means for said bulkhead; roller means secured to the upper opposite ends of said bulkhead for rolling engagement with said gutter, wherein the engagement between said roller means and said track means comprises the only support of said bulkhead, said bulkhead, including said flotation means, depending from said roller means in a vertical plane into the confines of said water-filled swimming pool vertical sidewalls; means to stabilize said bulkhead against unwanted movement comprising: jack means positioned between said gutter and said bulkhead to vertically lift said bulkhead and to shift the bulkhead load from said roller means to said jack means, whereby bulkhead resistance to vertical and horizontal movement is increased as a result of the shift of the load from said roller means to said jack means.

2. In a moveable bulkhead for use in a swimming pool having rectilinear vertical walls and a gutter that can be utilized as a supporting and guiding track means for said bulkhead; roller means secured to opposite ends of said bulkhead for rolling engagement with said gutter; roller mounting carriage means secured to said opposite ends of said bulkhead; and means to rotatably journal roller means in each of said roller mounting carriage means, the improvement in carriage means comprising: a carriage frame including a vertical plate adjustably securable to a bulkhead end; a first horizontal plate rigidly secured to said vertical plate and extending outwardly from said bulkhead end; a second horizontal load bearing plate subjacent to said first horizontal plate and providing roller receiving well means sized to permit said roller means to extend therethrough and to engage said gutter track means; means to bias said second horizontal plate toward said first horizontal plate; adjustable jack means to selectively overcome said biasing means and to space apart said first and second horizontal plates; whereby said roller means extend through said well means to engage said gutter track means when said first and second horizontal plates are in adjacency, and whereby said vertical plate, said first horizontal plate and said roller means are shifted away from said gutter track means and said second horizontal plate is urged into load bearing contact with said gutter track means when said first and second horizontal plates are separated by said adjustable jack means, wherein said biasing means comprise second hole means in said first horizontal plate; stud means secured to said second horizontal plate and positioned to project upwardly through said second hole means; adjustable spring retaining means secured to said stud means; and coiled spring means concentrically fitted about said stud means and positioned between the upper face of said first horizontal plate and said spring retaining means.

3. In a moveable bulkhead for use in a swimming pool having rectilinear vertical walls and a gutter that can be utilized as a supporting and guiding track means for said bulkhead; roller means secured to opposite ends of said bulkhead for rolling engagement with said gutter; roller mounting carriage means secured to said opposite ends of said bulkhead; and means to rotatably journal roller means in each of said roller mounting carriage means, the improvement in carriage means comprising a carriage frame including a vertical plate adjustably securable to a bulkhead end; a first horizontal plate rigidly secured to said vertical plate and extending outwardly from said bulkhead end; a second horizontal load bearing plate subjacent to said first horizontal plate and providing roller receiving well means sized to permit said roller means to extend therethrough and to engage said gutter track means; means to bias said second horizontal plate toward said first horizontal plate; adjustable jack means to selectively overcome said biasing means and to space apart said first and second horizontal plates; whereby said roller means extend through said well means to engage said gutter track means when said first and second horizontal plates are in adjacency, and whereby said vertical plate, said first horizontal plate and said roller means are shifted away from said gutter track means and said second horizontal plate is urged into load bearing contact with said gutter track means when said first and second horizontal plates are separated by said adjustable jack means, first hole means in said first horizontal plate, interior threaded nut means centered concentric with said first hole means and secured to the upper face of said first horizontal plate; mating threaded first stud means receivable by said nut means to extend through said first hole means and into pressure bearing contact with the upper face of said second horizontal plate; means to adjust said first stud means relative to said nut means; second hole means in said first horizontal plate, second stud means secured to said second horizontal plate and positioned to project upwardly through said second hole means; adjustable spring retainer means secured to said stud means; and coiled spring means concentrically fitted about said stud means and positioned between the upper face of said first horizontal plate and said spring retaining means.

4. In a moveable bulkhead for use in a swimming pool having rectilinear vertical walls and a gutter that can be utilized as a supporting and guiding track means for said bulkhead; roller means secured to opposite ends of said bulkhead for rolling engagement with said gutter; roller mounting carriage means secured to said opposite ends of said bulkhead; and means to rotatably journal roller means in each of said roller mounting carriage means, the improvement in carriage means comprising: a carriage frame including a vertical plate adjustably securable to a bulkhead end; a first horizontal plate rigidly secured to said vertical plate and extending outwardly from said bulkhead end; a second horizontal load bearing plate subjacent to said first horizontal plate and providing roller receiving well means sized to permit said roller means to extend therethrough and to engage said gutter track means; means to bias said second horizontal plate toward said first horizontal plate; adjustable jack means to selectively overcome said biasing means and to space apart said first and second horizontal plates; whereby said roller means extend through said well means to engage said gutter track means when said first and second horizontal plates are in adjacency, and whereby said vertical plate, said first horizontal plate and said roller means are shifted away from said gutter track means and said second horizontal plate is urged into load bearing contact with said gutter track means when said first and second horizontal plates are separated by said adjustable jack means; first hole means in said first horizontal plate, interior threaded nut means centered concentric with said first hole means and secured to the upper face of said first horizontal plate;

mating threaded first stud means receivable by said nut means to extend through said first hole means and into pressure bearing contact with the upper face of said second horizontal plate; means to adjust said first stud means relative to said nut means; second hole means in said first horizontal plate, second stud means secured to said second horizontal plate and positioned to project upwardly through said second hole means; adjustable spring retainer means secured to said stud means; coiled spring means concentrically fitted about said stud means and positioned between the upper face of said first horizontal plate and said spring retaining means; and coaxial holes in said first and second horizontal plates; and bulkhead anchor stud means adapted to be received through said coaxial holes for engagement with said gutter track means.

* * * * *